US007685760B1

(12) United States Patent
Neumaster

(10) Patent No.: US 7,685,760 B1
(45) Date of Patent: Mar. 30, 2010

(54) PAINTBALL MARKER SIGHT APPARATUS

(75) Inventor: Terry Neumaster, Lowell, AR (US)

(73) Assignee: JT Sports LLC, Bentonville, AR (US)

( * ) Notice: Subject to any disclaimer, the term of this patent is extended or adjusted under 35 U.S.C. 154(b) by 238 days.

(21) Appl. No.: 11/796,838

(22) Filed: Apr. 30, 2007

Related U.S. Application Data

(60) Provisional application No. 60/813,979, filed on Jun. 15, 2006.

(51) Int. Cl.
*F41G 1/42* (2006.01)
*F41G 1/00* (2006.01)

(52) U.S. Cl. ..... 42/129; 42/111; 42/130

(58) Field of Classification Search ..... 42/111, 42/119, 122, 123, 129, 130, 133, 140, 141, 42/142; 356/139.02; 33/297; D22/109
See application file for complete search history.

(56) References Cited

U.S. PATENT DOCUMENTS

| | | | | | |
|---|---|---|---|---|---|
| 659,606 | A * | 10/1900 | Formby | 42/142 |
| 1,260,545 | A * | 3/1918 | Jackson | 42/140 |
| 2,339,723 | A * | 1/1944 | Russell | 42/130 |
| 2,464,521 | A * | 3/1949 | McCall | 33/297 |
| 2,586,807 | A * | 2/1952 | Fowler | 42/141 |
| 3,381,380 | A * | 5/1968 | Thomas | 33/297 |
| 3,394,461 | A | 7/1968 | Thomas | |
| 3,700,339 | A | 10/1972 | Steck, III | 356/247 |
| 3,744,133 | A * | 7/1973 | Fukushima et al. | 42/121 |
| 3,981,588 | A * | 9/1976 | Wirtanen | 356/139.02 |
| 4,033,046 | A | 7/1977 | Burris | 33/297 |
| 4,205,916 | A | 6/1980 | Vogl et al. | 356/247 |
| 4,403,421 | A * | 9/1983 | Shepherd | 42/122 |
| 4,695,159 | A | 9/1987 | Cannon | 356/247 |
| 5,493,450 | A | 2/1996 | Ekstrand | 359/799 |
| 6,289,782 | B1 | 9/2001 | Watson, Jr. | 89/37.01 |
| 6,295,754 | B1 | 10/2001 | Otteman et al. | 42/124 |
| 6,445,497 | B1 | 9/2002 | Adda | 359/428 |
| 6,508,026 | B1 | 1/2003 | Uppiano et al. | 42/119 |
| 6,516,699 | B2 * | 2/2003 | Sammut et al. | 89/41.17 |
| 6,811,268 | B2 * | 11/2004 | Watson | 359/611 |
| 6,862,833 | B1 * | 3/2005 | Gurtner | 42/120 |
| 2005/0066950 | A1 | 3/2005 | Yu | |
| 2005/0086848 | A1 * | 4/2005 | Dietz | 42/130 |
| 2007/0234627 | A1 * | 10/2007 | Scherpf | 42/146 |

* cited by examiner

*Primary Examiner*—Bret Hayes
(74) *Attorney, Agent, or Firm*—Keisling Pieper & Scott, PLC; Meredith K. Lowry

(57) ABSTRACT

A sight apparatus for attachment to a paintball marker having two distinct reticles to assist with the placement accuracy of paintballs. The sight apparatus comprises a body, a first reticle and a second reticle. The first reticle is substantially transparent and includes a diameter line, at least two radius lines, and at least three segment lines extending from each of at least two radius lines. The second reticle is substantially transparent and has a rectangular outline.

3 Claims, 6 Drawing Sheets

PAINTBALL MARKER SIGHT APPARATUS

CROSS-REFERENCE TO RELATED APPLICATIONS

This application claims priority to and is a continuation-in-part of U.S. provisional application Ser. No. 60/813,979, filed Jun. 15, 2006.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball marker accessories. In particular, the present invention relates specifically to a paintball marker sight.

2. Description of the Known Art

As will be appreciated by those skilled in the art, sight devices are used to increase accuracy of shooting. Patents and patent publications disclosing information relevant to sights and paintball sights include U.S. Pat. No. 3,394,461, issued to Thomas on Jul. 30, 1968; U.S. Pat. No. 3,700,339, issued to Steck on Oct. 24, 1972; U.S. Pat. No. 4,033,046, issued to Burris on Jul. 5, 1977; U.S. Pat. No. 4,205,916, issued to Vogl et al. on Jun. 3, 1980; U.S. Pat. No. 4,695,159, issued to Cannon on Sep. 22, 1987; U.S. Pat. No. 5,493,450, issued to Ekstrand on Feb. 20, 1996; U.S. Pat. No. 6,289,782, issued to Watson on Sep. 18, 2001; U.S. Pat. No. 6,295,754, issued to Otteman et al. on Oct. 2, 2001; U.S. Pat. No. 6,445,497, issued to Adda on Sep. 3, 2002; U.S. Pat. No. 6,508,026, issued to Uppiano et al. on Jan. 21, 2003; United States Patent Application Publication No. 2005/0066950, published for Yu on Mar. 31, 2005. Each of these patents are hereby expressly incorporated by reference in their entirety.

U.S. Pat. No. 3,394,461, issued to Thomas on Jul. 30, 1968 entitled Reticle Construction. The abstract provides the following information. A reticle having a cored wire wherein the cover for the core is reduced or the core expose at a central portion thus to create the effect of a tapered reticle.

U.S. Pat. No. 4,033,046, issued to Burris on Jul. 5, 1977 entitled Riflescope Reticle. The abstract provides the following information. This invention relates to a reticle for riflescopes and the like having crossed filaments defining the aiming reference, the center sections of such wires being flattened in a direction parallel to the viewing axis.

U.S. Pat. No. 4,205,916, issued to Vogl et al. on Jun. 3, 1980 entitled Artillery Collimator Symbol Plate. The abstract provides the following information. A symbol plate for an artillery collimator and an artillery gun sight has a vertical center line across the plate and symbols arranged in a row symmetrically in relation to the center line. The symbols are formed of digits which are arranged to indicate numeral values proportionally variable with the distance to the center line, the digits being arranged with opposite inclination on opposite sides of the center line.

U.S. Pat. No. 6,445,497, issued to Adda on Sep. 3, 2002 entitled Optical Sighting System. The abstract provides the following information. An optical sighting system includes at least one optical channel with which there is associated at least one reticle. The reticle includes at least one mark which demarcates a blind spot, which is visible to an observer using the optical sighing system and which is centered approximately about a centering point that is situated substantially at a distance which is representative of a sighting angle of between 13. degree. and 18. degree., with respect to a predetermined direction of observation along a first direction. This first direction is representative on the optical sighting system of the direction passing substantially by the centers of the eyes of an observer who is using the optical sighting system.

U.S. Pat. No. 3,700,339, issued to Steck on Oct. 24, 1972 entitled Gun Sight. The abstract provides the following information. A sight for use with a firearm which sight includes a fluorescent reticle mounted in a holder which also carries a collimating lens operative to direct the image of the reticle along parallel lines to the eye of the shooter. The sight is sufficiently small, and is designed for use at a distance of three to four feet from the eye of the shooter so as to obscure very little of the image of the target from the field of vision of the shooter's eye, thereby permitting a shooter to use the sight with either one eye or two eyes open.

Thus, it may be seen that these prior art patents are very limited in their teaching and utilization, and an improved sight for use with a paintball gun is needed to overcome these limitations.

SUMMARY OF THE INVENTION

The present invention is directed to an improved sight apparatus for a paintball marker. In accordance with one exemplary embodiment of the present invention, a sight for a paintball marker is provided having two differing reticles and a point sight enclosed within a body adapted to be attached to a paintball marker, an airgun, a firearm, a crossbow, or a compound bow.

In one embodiment, the invention includes a first reticle having a diagram to assist a user of the sight apparatus in determining the arcuate path of a target location, a second reticle having a diagram to assist a user of the sight apparatus in determining the range of a discharged paintball, and a point sight to assist a user of the sight apparatus in determining a point of impact of a discharged paintball. It is an object of the present invention to increase the accuracy of placement of discharged paintballs.

The body of the sight apparatus generally includes a body portion and reticle portions composed of a durable, lightweight material, such as plastic, to allow for safe, easy transportation of the sight apparatus during use. When attached to a paintball marker, the body generally extends along the longitudinal axis of the paintball marker. Attachment ports having dovetail rails may further be included on the exterior of the sight apparatus to allow for the attachment of additional accessories and a larger attachment port to allow for the attachment of the sight to the paintball marker. The main attachment port generally includes a platform to distance the sight from the paintball marker body.

The sight apparatus contains two reticles: a first reticle placed at the rear end of the sight apparatus and a second reticle placed at the front end of the sight apparatus. The reticles may be composed of a variety of materials, including plastic or glass, however the chosen material must be substantially transparent to allow a user of the sight apparatus to see through the sight. The first reticle assists a viewer in determining the arcuate flight path of a paintball discharged from a paintball marker. Further, the first reticle presents an angle configuration which may be utilized to frame the body of an opposing player to determine the distance to that player. The second reticle assists a viewer in determining the range of a paintball discharged from a paintball marker for up to one hundred feet.

The sight apparatus may include additional tools for increasing the accuracy of a paintball. These tools include a point sight, a LED flashlight, an LCD display screen, or an OLED display screen. The point sight may serve as a guide for a user of the sight apparatus on a paintball marker to ascertain if he or she is pointing the marker in the appropriate direction when engaging the trigger of the marker. Further, the rotation of the butt of the paintball marker stock downward by the paintball player raises the aim point of the reflected beam of light from the point sight on the front reticle. Additionally, this downward rotation raises the marker barrel equal to the aim point of light. Further, the point sight may be used in conjunction with a covered first reticle to create an occluded paintball sight.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
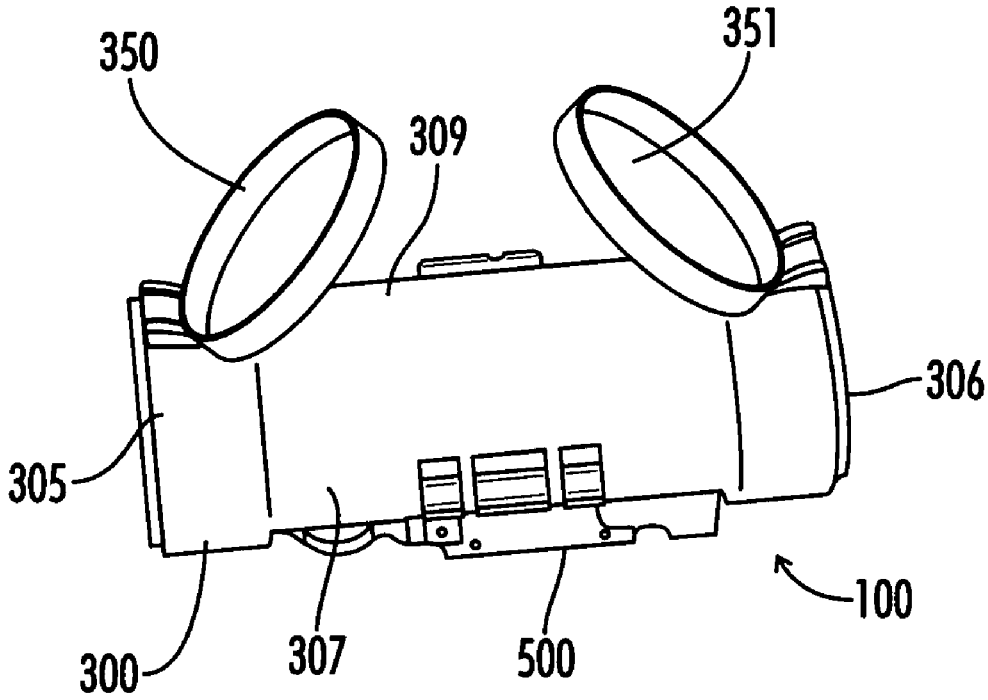
FIG. 1 is a top perspective view of a paintball marker sight.
Figure 2:
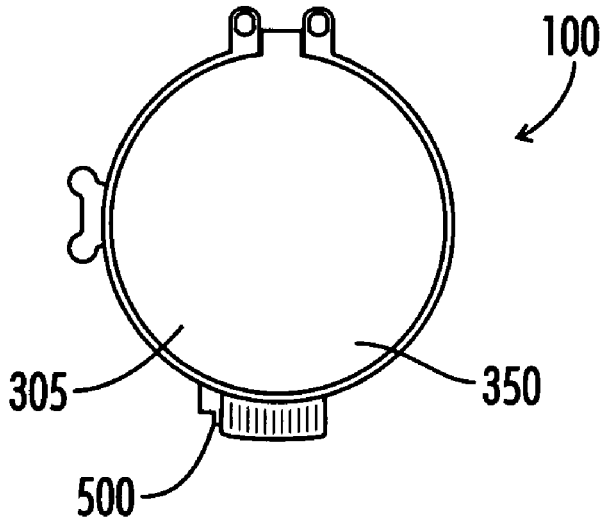
FIG. 2 is a front elevational view thereof.

As shown in FIG. 1 through FIG. 8 of the drawings, the present invention is shown as a sight apparatus 100 for a paintball marker. As contemplated by the present invention, the sight apparatus 100 is suitable for mounting on a paintball marker along the longitudinal axis of the paintball marker. The sight apparatus 100 is further suitable for mounting on a variety of other an airgun, a firearm, a crossbow, or a compound bow.

As shown in the drawings, the sight apparatus 100 generally includes a body 300, an attachment port 500, a first reticle 600, a second reticle 800, and a point sight 900.

The sight apparatus 100 is housed within a hollow container or body 300. As shown, the body 300 can formed from a canister or tube structure suitable for mounting to a paintball marker. Other suitable structures, such as rectangular or octagonal cylinders, may be additionally utilized to form the body 300 of the sight apparatus 100. The body is composed of a durable, lightweight material, such as plastic, to allow for safe, easy transportation of the sight apparatus 100 during use. The body 300 generally has a forward end 305, a rearward end 306, a left side 307, a right side 308, a top 309, and a bottom 310. When attached to a paintball marker, the body generally extends between the forward end 305 and the rearward end 306 along the longitudinal axis of the paintball marker. The body 300 encloses a hollow interior 315 allowing a user of a paintball marker to see through an opening 311 in the forward end 305 to an opening 312 in the rearward end 306 of the body 300.

Figure 3:
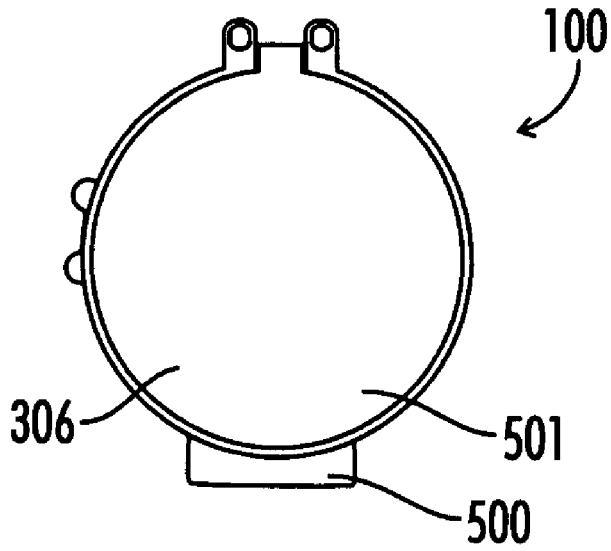
FIG. 3 is a rear elevational view thereof.
Figure 4:
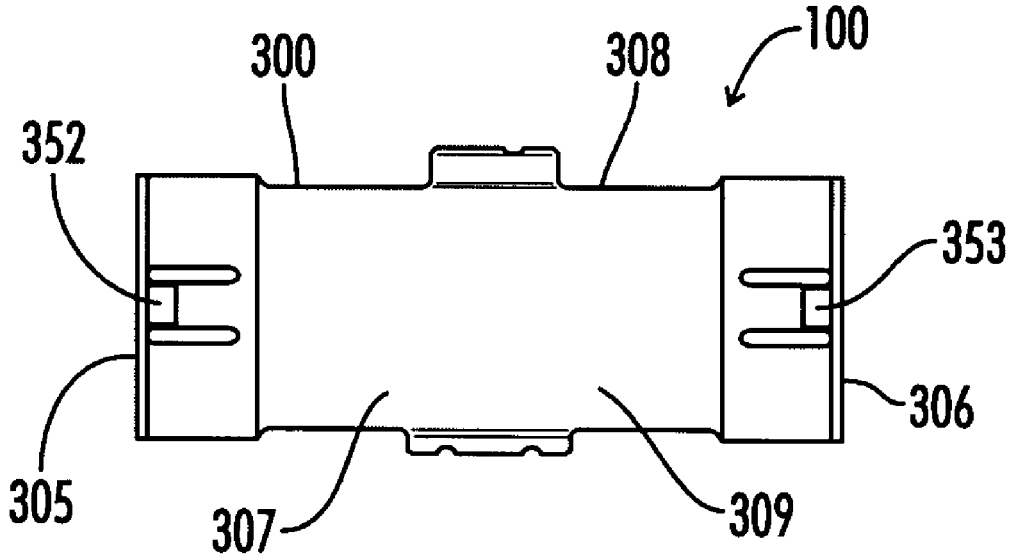
FIG. 4 is a top plan view thereof.
Figure 5:
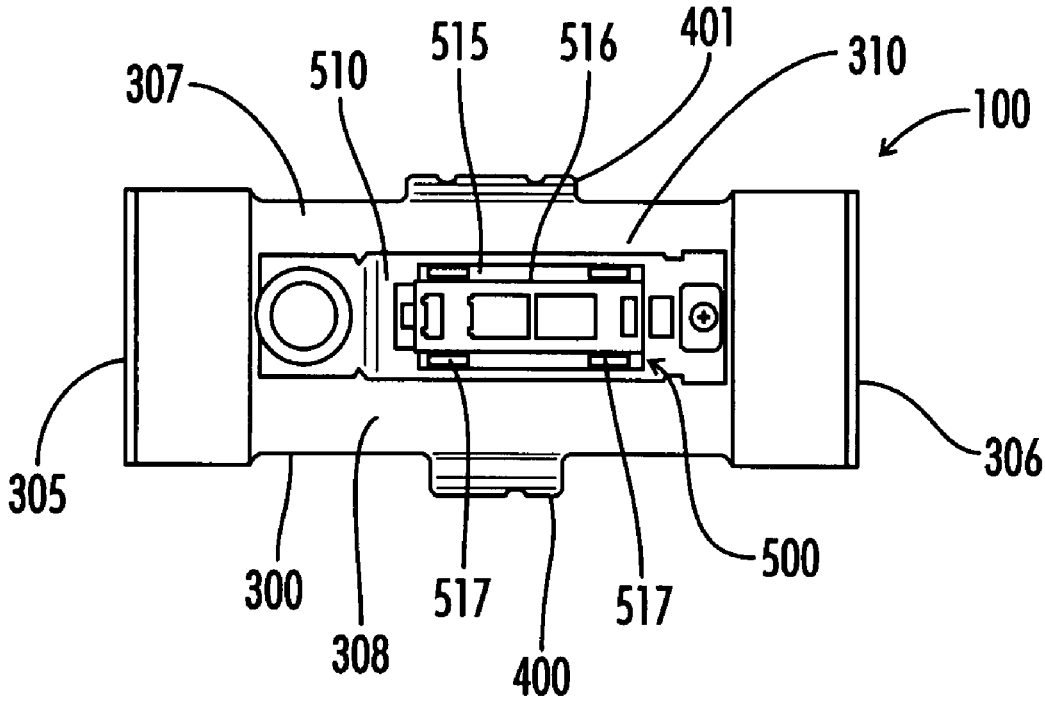
FIG. 5 is a bottom plan view thereof.
Figure 6:
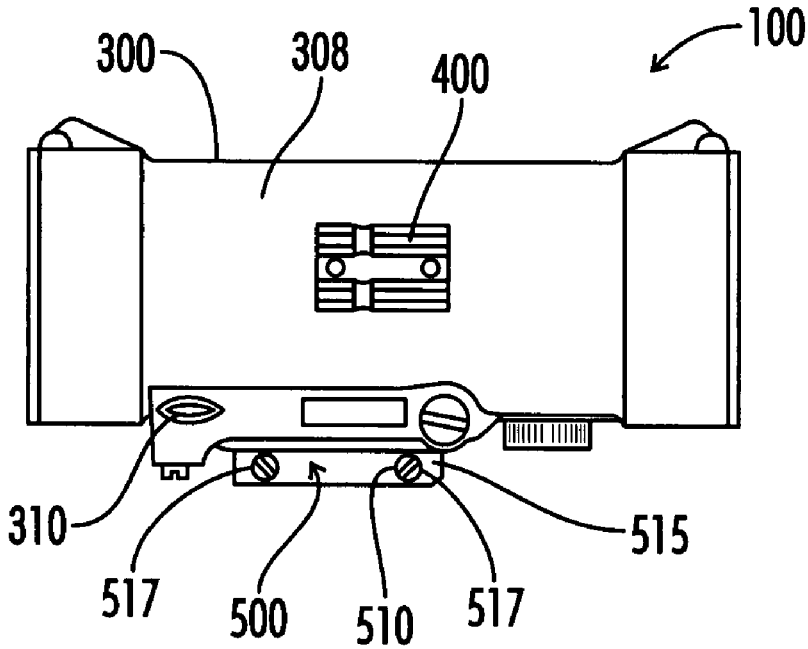
FIG. 6 is a right elevational view thereof.
Figure 7:
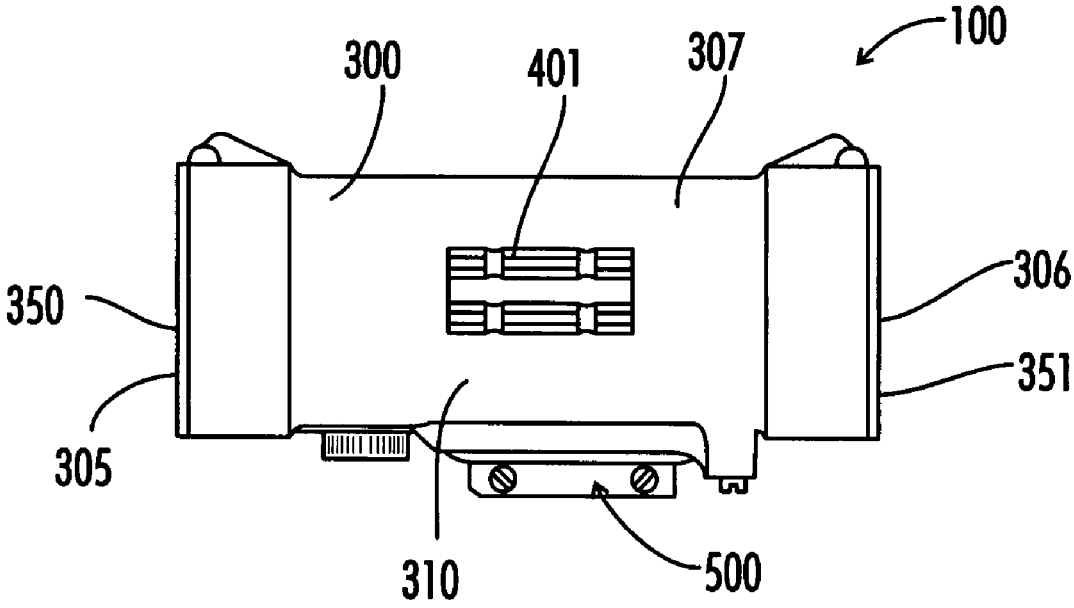
FIG. 7 is a left elevational view thereof.

The body 300 of the sight apparatus may further include reticle covers 350, 351 at the forward end 305 and the rearward end 306. The reticle covers 350, 351 are adapted to protect the first reticle 600 and the second reticle 800 while the sight apparatus 100 is not in use. As shown in FIG. 3 and FIG. 5, the reticle covers 350, 351 are the same shape as the opening 311, 312 of the forward end 305 and rearward end 306 of the body 300. The reticle covers 350, 351 may be attached to the body in a variety of ways, including the use of tethers, clamps or other similar attachment means. In the preferred embodiment, the reticle covers 350, 351 are connected by a hinge 352, 353 to the body 300 of the sight apparatus 100. The hinge 352, 353 is adapted to allow a user of the sight apparatus to access the covered reticles 600, 800 quickly by the pressure of one finger against the reticle covers 350, 352.

Attachment ports 400, 401 may further be included on the exterior sides 307, 308 of the body 300 of the sight apparatus 100 to allow for the attachment of additional accessories to the sight apparatus 100. The attachment ports 400, 401 are placed on the left 307 and right 308 sides of the body 300. In the preferred embodiment, the attachment ports 400, 401 feature ⅜ dovetail joints for attachment.

As shown in FIG. 5, the sight apparatus 100 has an attachment port 500 positioned on the bottom 310 of the body 300 to allow connection of the sight apparatus 100 to a paintball marker. The attachment port generally includes a platform 510 and an attachment means 515. As can be appreciated, the shape of the body 300 may require the use of the platform 510 to distance the body 300 from the paintball marker body. The platform 510 provides a uniformly planar surface for placement of the attachment means 515 of the sight apparatus 100. A variety of attachment means 515 can be utilized to connect the sight apparatus 100 to a paintball marker. These means include clamps, screws, and dovetail grooves. In the preferred embodiment, the sight apparatus 100 is attached utilizing a clamp 516. For attachment, the clamp 516 can be placed around a portion of a paintball marker, properly positioned, and then a set of screws 517 can be tightened to draw the clamp 516 together around the portion of the paintball marker until secure. Some paintball markers will not have an appropriate location on the marker for attachment of the sight apparatus 100, and therefore, it may be necessary to have a subsequent accessory for placement on the paintball marker to provide an attachment location for the sight apparatus 100. The sight apparatus 100 may be positioned either above the paintball marker or along the side of the paintball marker.

As shown in FIGS. 8 through 11, the sight apparatus 100 contains two reticles: a first reticle 600 placed at the rearward end 306 of the sight apparatus 100 and a second reticle 800 placed at the forward end 305 of the sight apparatus 100.

Figure 10:
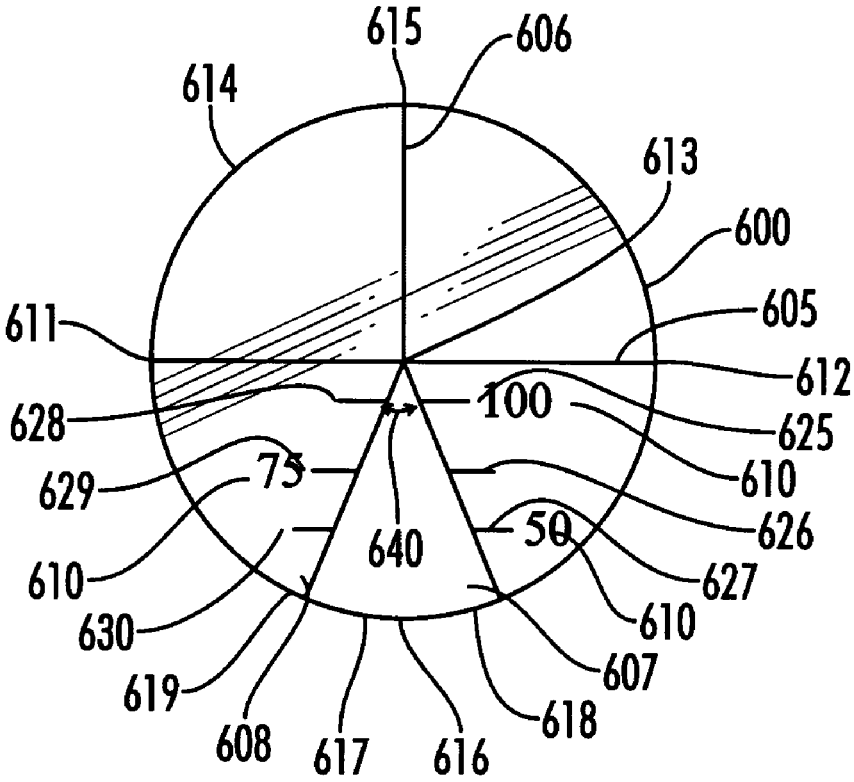
FIG. 10 is a plan view of the first reticle of the paintball marker sight.

The first reticle 600 assists a viewer in determining the arcuate flight path of a paintball discharged from a paintball marker. The first reticle 600 may be composed of a variety of materials, including plastic or glass, however the chosen material must be substantially transparent to allow a user of the sight apparatus 100 to see through the sight. The first reticle 600 is generally shaped in accordance with the opening 312 of the rearward end 306 of the sight apparatus 100. In the preferred embodiment, the opening 312 and the first reticle 600 are circular. As shown in FIG. 10, the first reticle 600 has a multitude of lines. These lines may be placed on the reticle by various methods, such as painting or etching, and can be various colors depending upon the background for use of the sight apparatus 100. In the preferred embodiment, the lines on the first reticle 600 are painted black.

The first reticle 600 is generally composed of a straight diameter line 605, three radius lines 606, 607, 608, and six segment lines. In a preferred embodiment, the first reticle 600 also includes reference numerals 610 to note distance to the user of the paintball marker. The diameter line 605 is the length of the diameter of the reticle and extends from the left side 611 of the first reticle 600 to the right side 612 of the first reticle 600 bisecting the first reticle 600. The three radius lines 606, 607, 608 radiate from the center 613 of the first reticle 600 and extend to the perimeter 614 of the first reticle 600. The first radius line 606 extends upwards from the center 613 to the top 615 of the first reticle 600. The second radius line 607 and the third radius line 608 extend downwards from the center 613 towards the bottom 616 of the first reticle. The angle 640 created by the intersection of the second radius line 607 and the third radius line 608 is acute measuring between forty and fifty degrees. The second radius line 607 has three segment lines 625, 626, 627 extending towards the right side 612 of the first reticle 600 parallel with, the diameter line 605. The third radius line 608 has three segment lines 628, 629, 630 extending towards the left side 611 of the first reticle parallel with the diameter line 605.

The diameter line 605 and the three radius lines 606, 607, 608 intersect the perimeter 614 of the first reticle 600 at five points creating five distinct arcs. The bottom arc 617 created between the end point 618 of the second radius line 607 and the end point 619 of the third radius line 608 is smaller in length than the remaining four arcs. The smaller arc 617 positions the second radius line 607 and the third radius line 608 closer together, thus influencing the position of the segment lines.

The segment lines, as mentioned before, note distances. In the preferred embodiment, reference numerals 610 are placed next to the segment lines to relate a specific distance with a specific segment line. Specifically, a reference numeral 610 of "100" is placed next to the top segment line 625 on the right side 612 of the first reticle 600, a reference numeral 610 of "75" is placed next to the middle segment line 629 on the left side 611 of the first reticle 600, and a reference numeral 610 of "50" is placed next to the bottom segment line 627 on the right side 612 of the first reticle 600. It is envisioned that the reference numerals 610 may be placed on alternating sides of the first reticle 600. In this manner, a user of the present invention with a paintball marker may judge the flight distance of a paintball discharged from the marker. Further, the angle width at the various segment lines created by the intersection of the second radius line 607 and the third radius line 608 may be used to judge the distance of an opposing player by placing the shoulder span of the player within the angle.

The first reticle 600 is placed proximate the rearward end 306 of the sight apparatus 100. The first reticle 600 is oriented perpendicular to the longitudinal axis of the paintball marker and positioned such that the diameter line 605 is transverse to the longitudinal axis of the paintball marker when said body is attached to the paintball marker.

Figure 9:
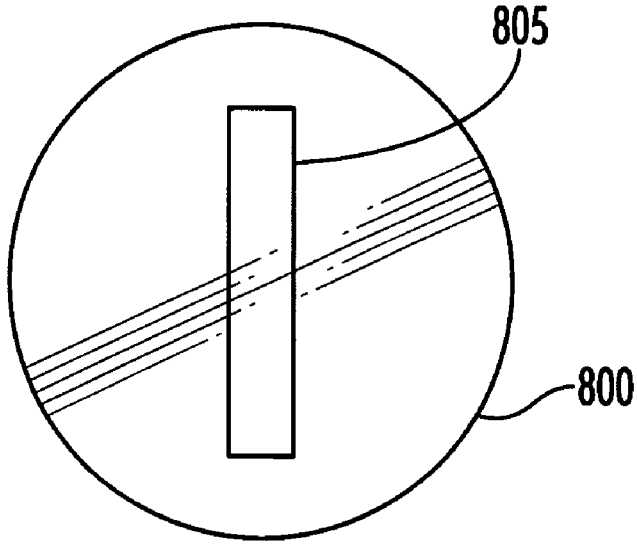
FIG. 9 is a plan view of the second reticle of the paintball marker sight.

The second reticle 800 assists a viewer in determining the range of a paintball discharged from a paintball marker for up to one hundred feet. The second reticle 800 may be composed of a variety of materials, including plastic or glass, however the chosen material must be substantially transparent to allow a user of the sight apparatus 100 to see through the sight. The second reticle 800 is generally shaped in accordance with the opening 311 of the forward end 305 of the sight apparatus 100. In the preferred embodiment, the opening 311 and the second reticle 800 are circular. As shown in FIG. 9, the second reticle 800 has a multitude of lines. These lines may be placed on the reticle by various methods, such as painting or etching, and can be various colors depending upon the background for use of the sight apparatus 100. In the preferred embodiment, the lines on the second reticle 800 are painted black.

The second reticle 800 is generally composed of a rectangular outline 805 positioned in the center of the second reticle 800. The second reticle 800 is placed proximate the forward end 305 of the sight apparatus 100. The second reticle 800 is oriented perpendicular to the longitudinal axis of the paintball marker and positioned such that a base of the rectangular outline 805 is transverse to the longitudinal axis of the paintball marker when said body is attached to the paintball marker.

Figure 8:
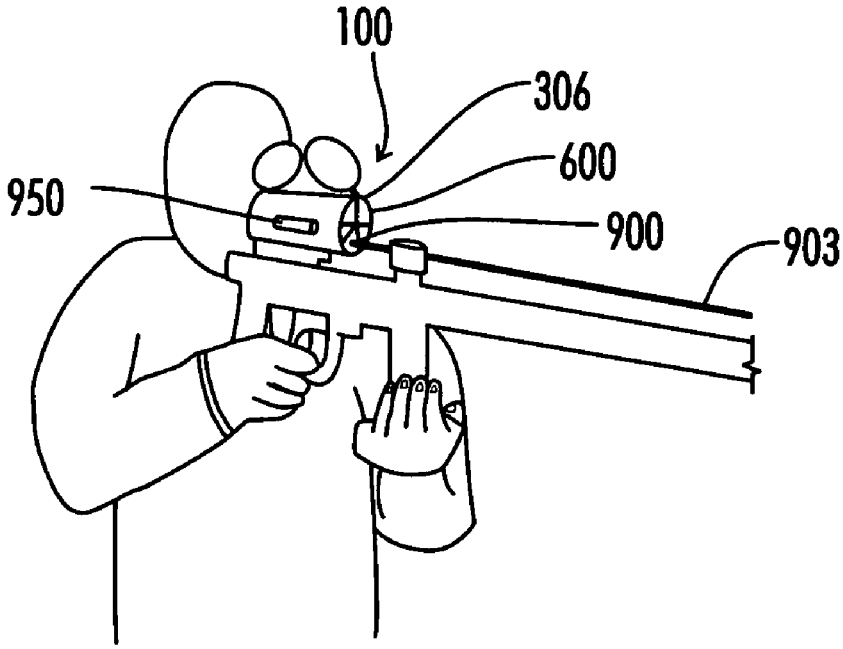
FIG. 8 is an environmental view thereof.
Figure 11:
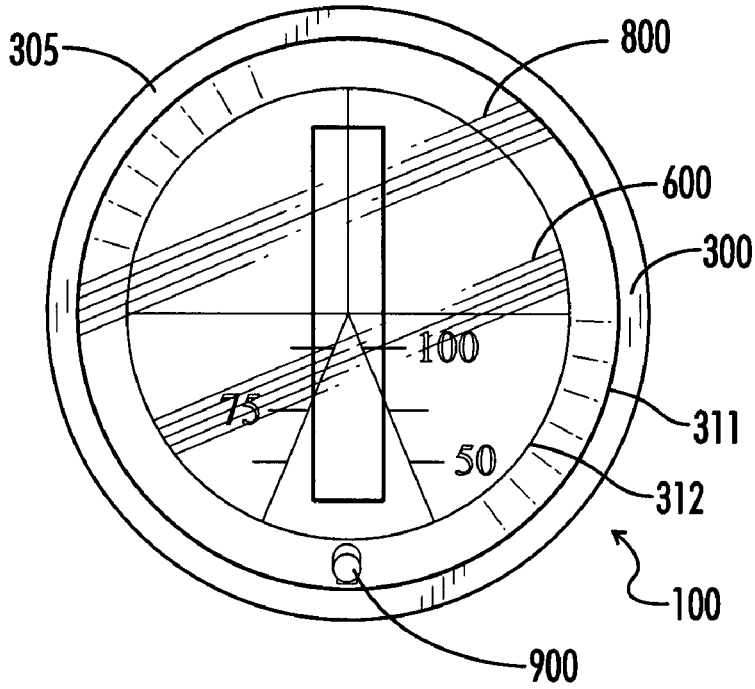
FIG. 11 is a rear elevational view of the paintball marker sight.
Figure 12:
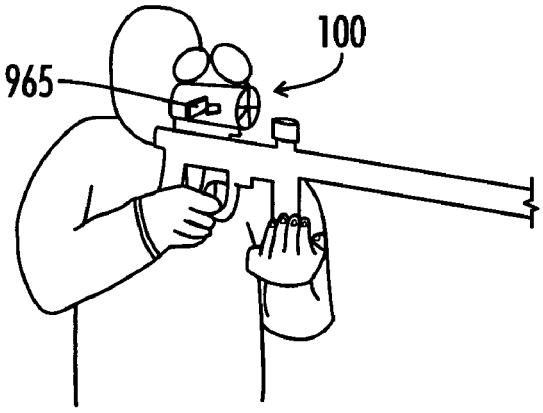
FIG. 12 is an environmental view showing additional accessories.
Figure 13:
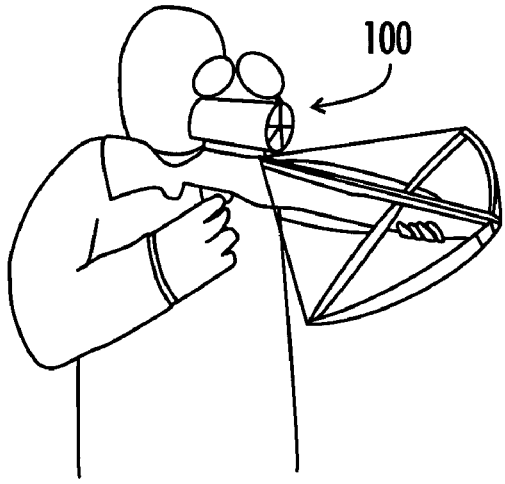
FIG. 13 is an environmental view of the paintball marker sight.

As shown in FIG. 11, the sight apparatus 100 includes a point sight 900 placed within the hollow interior 315 of the body 300. The point sight 900 is adapted to transmit a beam of light through the opening 312 of rearward end 306 of the body 306 to illuminate a portion of a target. The point sight 900 may consist of a LED point sight. In the preferred embodiment, the point sight 900 may be a red LED point sight adapted for low light conditions. In another embodiment, the point sight 900 may consist of a LED point sight adapted for full sunlight conditions. In another embodiment, the point sight 900 may further include a self-adjusting laser for range-finding capabilities. The beam 903 of light, as shown in FIG. 8, is parallel to the longitudinal axis of the paintball marker. Thus, the point sight 900 serves as a guide for a user of the sight apparatus 100 on a paintball marker to ascertain if he or she is pointing the marker in the appropriate direction when engaging the trigger of the marker. Further, the rotation of the butt of the paintball marker stock downward by the paintball player raises the aim point of the reflected beam 903 of light from the point sight on the front reticle 600. Additionally, this downward rotation raises the marker barrel equal to the aim point of light. Further, the use of the point sight 900 may be used with either one eye or two eyes open. It is contemplated that the reticle cover 350 of the forward end 305 of the paintball sight 100 can be closed to create an occluded paintball sight 100. This occluded paintball sight 100 super-imposes a dot upon a target when both eyes are open.

The sight apparatus 100 may further include a LED flashlight 950, an LCD display screen 965, or an OLED display screen 970. The LED flashlight 950, LCD display screen 965, and the OLED display screen 970 may be attached to the sight apparatus 100 at the attachment ports 400, 401 on the body 300 of the apparatus 100. It is envisioned that the LCD display screen 965 or the OLED display screen 970 will be adapted to show a user of the sight apparatus 100 the number of discharged ammunition, the time of the playing session, the remaining time for play, the temperature, the GPS location, and the time of day. It is envisioned that the LCD display screen 965 or the OLED display screen 970 will be electronically connected to the electronic components of the paintball marker.

Reference numerals used throughout the detailed description and the drawings correspond to the following elements:

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A sight apparatus for attachment to a paintball marker along the longitudinal axis of the paintball marker to assist with the placement accuracy of paintballs, the sight apparatus comprising:

a body consisting essentially of a tube extending between a forward end and a rearward end along a longitudinal axis parallel to a longitudinal axis of a paintball marker, said forward end comprising a first reticle and said rearward end comprising a second reticle;

said first reticle being substantially transparent and comprising a diameter line, at least two radius lines, and at least three segment lines extending from each of at least two radius lines, said first reticle positioned such that said diameter line is transverse to said longitudinal axis of said body;

said second reticle being substantially transparent and having a rectangular outline having a short leg and a long leg, said second reticle positioned such that said short leg of said rectangular outline is transverse to said longitudinal axis of said body.

2. A sight apparatus for attachment to a paintball marker to assist with the placement accuracy of paintballs, the sight apparatus consisting essentially of:

a body having attachment means for securing said body to a paintball marker, said body extending between a forward end and a rearward end with a longitudinal axis parallel to a longitudinal axis of the paintball marker;

a substantially transparent first reticle comprising a diameter line, at least two radius lines, and at least three segments extending from each of at least two radius lines, said first reticle perpendicular to said longitudinal axis of said body;

a substantially transparent second reticle having a rectangular outline having a short leg and a long leg, said second reticle positioned perpendicular to said longitudinal axis of said body such that said short leg of said rectangular outline is transverse to said longitudinal axis of said body;

at least one reticle cover connected said body; and a point sight capable of transmitting a beam of light through said rearward end of said body to illuminate a portion of a target.

3. A sight apparatus for attachment to a paintball marker to assist a paintball marker user with the placement accuracy of paintballs, the sight apparatus comprising:

a substantially transparent first reticle comprising a rectangular outline having two parallel short legs and two parallel long legs; and a second reticle consisting essentially of:

a diameter line, a radius line extending perpendicular from said diameter line;

at least two additional radius lines forming an acute angle;

at least three segments extending from each of at least two radius lines, and numerical figures proximate to at least three segment lines.

* * * * *